US007581982B2

(12) United States Patent
Mehnert et al.

(10) Patent No.: US 7,581,982 B2
(45) Date of Patent: Sep. 1, 2009

(54) ELECTRICAL PLUG CONNECTOR

(75) Inventors: Wolfgang Mehnert, Lindau (DE); Gilbert Anzer, Friedrichshafen (DE)

(73) Assignee: i f m electronic GmbH, Essen (DE)

( * ) Notice: Subject to any disclaimer, the term of this patent is extended or adjusted under 35 U.S.C. 154(b) by 0 days.

(21) Appl. No.: 12/279,275

(22) PCT Filed: Feb. 12, 2007

(86) PCT No.: PCT/EP2007/001182

§ 371 (c)(1),
(2), (4) Date: Aug. 13, 2008

(87) PCT Pub. No.: WO2007/093344

PCT Pub. Date: Aug. 23, 2007

(65) Prior Publication Data

US 2009/0023329 A1 Jan. 22, 2009

(30) Foreign Application Priority Data

Feb. 13, 2006 (DE) ..... 10 2007 006 726

(51) Int. Cl.
*H01R 3/00* (2006.01)

(52) U.S. Cl. ..... 439/490

(58) Field of Classification Search ..... 439/490, 439/488, 489, 910; 524/407; 425/131.1; 362/291

See application file for complete search history.

(56) References Cited

U.S. PATENT DOCUMENTS 5,244,409 A 9/1993 Guss, III et al.
5,567,175 A * 10/1996 Warden et al. ..... 439/490
6,259,170 B1 7/2001 Limoge et al.
6,336,825 B1 * 1/2002 Seefried ..... 439/488
6,690,804 B2 2/2004 Everett
7,118,407 B2 * 10/2006 Ching ..... 439/488
2002/0198302 A1 * 12/2002 Rouse et al. ..... 524/407
2004/0102095 A1 * 5/2004 Huang ..... 439/610
2005/0124209 A1 * 6/2005 Currie et al. ..... 439/490
2007/0126570 A1 6/2007 Kathan et al.

FOREIGN PATENT DOCUMENTS

EP 0 700 130 A2 3/1996
EP 1 624 538 A1 2/2006

OTHER PUBLICATIONS

International Search Report for International Application No. PCT/EP2007/001182.

* cited by examiner

*Primary Examiner*—Chandrika Prasad
(74) *Attorney, Agent, or Firm*—David S. Safran; Roberts Mlotkowski Safran & Cole, P.C.

(57) ABSTRACT

An electrical plug connector for connection of an electrical cable (2) to an apparatus, such as a sensor or an actuator, includes a housing (3) having a contact mount (5) holding a variety of contacts (4), and an electronics circuit (6) having at least one light-emitting element, LED (7) and being electrically connected to the contacts (4). The status of whether the LED (7) is illuminated or not can be identified particularly well, even in the presence of strong external incident light, by the housing (3) being composed of a thermoplastic material, at least in the area of the LEDs (7), and including an additive (8) that influences transparency and color for reducing the transparency of the thermoplastic material.

15 Claims, 4 Drawing Sheets

ELECTRICAL PLUG CONNECTOR

BACKGROUND OF THE INVENTION

1. Field of Invention

The invention relates to an electrical plug connector for connection of an electrical cable to an apparatus, and in particular to a sensor or an actuator, or for detachable connection of two electrical cables to one another, and having a housing, including a contact mount, which holds a variety of contacts, and an electronics circuit, which is arranged in the housing, with the electronics circuit having at least one light-emitting element, including an LED, and being electrically connected to the contacts.

2. Description of Related Art

Essentially, electrical plug connections are composed of two parts, the electrical plug connector and the mating plug connector. Electrical plug connections can either be used to connect an electrical cable to an electrical or electronic appliance, or to connect two cables to one another. In the first case, the mating plug connector is connected to the electrical housing, and in the second case it is connected to the cable. Both the plug connector and the mating plug connector each have a contact mount with corresponding contacts, which are either contact pins or the corresponding sockets. Dependent on whether the contact pins or sockets are arranged in the respective contact mount, the associated connecting part is referred to as a plug or a socket.

In the case of plug connections such as these, it is known for the plug connector and the mating plug connector to be mechanically connected to one another by, for example, arranging a union nut on the plug connector, which is screwed to the thread that is formed on the outer sleeve of the mating plug connector. In this case, the union nut then has an internal thread, which corresponds with the thread on the mating plug connector. However, as an alternative to this, it is also possible for a union screw to be arranged on the plug connector and to have an external thread, so that the plug connector with the union screw can be screwed into an outer sleeve, which has a corresponding internal thread, on the mating plug connector.

Electrical plug connections or plug connectors such as these are used in automation, as a component of electronic equipment, sensors, actuators and controllers. In this case, in particular, M12 and M8 types are in widespread use, with three, four, five or eight contacts, in which case the electrical plug connectors and mating plug connectors are known both in a straight form and in a form angled through 90°. In the case of the latter, the housing of the electrical plug connector is angled through 90°, so that there is an angle of 90° between the longitudinal direction of the connecting cable being held and the longitudinal direction of the contacts. Corresponding plug connections are known, for example, from the 2005 Catalogue "Positionssensorik or Position Sensor System," pages 430-444 from ifm electronic, gmbh.

Electrical plug connectors such as these can either be connected as required or can be ready-wired, in which case the contact mount and the cable are extrusion-coated with the housing, which is then also referred to as a grip. Finally, electrical plug connectors may also be in the form of adapters, with the plug connector then having two contact mounts, which can each be connected to a corresponding mating contact mount. In this case, as a rule, a cable which has already been connected to a corresponding mating contact mount is connected at least to one contact mount, while the other contact mount is then generally connected to the mating contact mount of a device or apparatus.

Electrical plug connectors of the type described initially and which are used in particular for connection of an electrical connection to an appliance, in particular a sensor, also have, in addition to the contact mount, an electronics circuit having at least one light-emitting element, generally a light emitting diode (LED). The LEDs, of which there are up to three in practice, are in this case used to visually signal the serviceability and in particular the switching state of the connected sensor. For this purpose, either an appropriate window is formed in the housing, which is generally closed by a separate, transparent cover, or the housing is entirely composed of a transparent material. In this way, the light beams emitted from the LEDs can pass either through the transparent cover or through the transparent material of the housing, so that the status of the LED can be seen.

The first variant has the disadvantage that, first of all, the production is relatively complex and costly since the various parts, e.g., the housing and cover, must be produced and connected to one another, for example, by adhesive bonding or ultrasound welding. Furthermore, the two-part configuration means that sealing problems also can occur, so that, for applications in which the sealing of the housing is significant, the complexity and thus also the costs for production of a corresponding electrical plug connector can rise further.

For this reason, in practice, a transparent plastic increasingly is being used to produce the housing for electrical plug connectors having at least one LED. For applications in which the electrical plug connector is subject to strong external incident light, there is a problem, however, in that it is often no longer reliably possible to tell whether or not an LED is illuminated. Because of the transparent material that is used, it is also possible in particular in this case for reflections to occur of the light striking the plug connector from outside onto components arranged in the housing, wherein it is then virtually impossible to distinguish the reflected light from the light from the LED.

SUMMARY OF THE INVENTION

The present invention is therefore based on the object of providing an electrical plug connector that avoids the disadvantages mentioned above and furthermore can be produced as easily as possible, and thus at a lower cost. This object is achieved, wherein the housing is composed of a thermoplastic material, at least in the area of the light-emitting element, with the thermoplastic material having an additive that influences the transparency and color, and which reduces the transparency of the thermoplastic material. Contrary to the procedure that has been practiced until now in the prior art of using a highly transparent material at least in the area of the light-emitting element, the present invention now proposes that the transparency of the material be deliberately reduced. In this case, this is done by adding an additive to the thermoplastic material for production of the housing, thus advantageously reducing the color and hence the transparency of the housing.

In this case, a color concentrate with organic and/or inorganic dyes is preferably used as the additive, and is added to the thermoplastic material in the form of powder or granulate. The dyes preferably have a grey or black color, so that the complete housing also overall has a grey to black color. The proportion by weight of the additive can be less than 5%, preferably between 1% and 3%, and in particular about 2%, thus making it possible to reduce the transparency by about 60% to 80%, and preferably by about 70%.

As before, the coloring of the housing according to the invention makes it possible to tell whether an LED is illuminated from the outside through the housing, furthermore resulting in a considerable increase in contrast, so that the status of an LED can be seen well, even when the plug connector is subject to strong external incident light. In this case, the thermoplastic materials, in particular polyurethane, thermoplastic elastomer or polyvinyl chloride, can still be used as the basic material for the housing, so that the production process for the electrical plug connector can remain virtually unchanged.

According to one preferred embodiment of the invention, the housing of the electrical plug connector is composed entirely of the thermoplastic material, which is provided with the additive. The housing can thus still be produced in a single injection-moulding process. No sealing problems can occur at junctions between different housing parts. Furthermore, the use of a housing that is colored overall, has the advantage that the electronics circuit, which is arranged within the housing and/or is extrusion-coated by the thermoplastic material, can no longer be seen as clearly from the outside as would be the case with a "completely" transparent housing. Advantageously, a user's attention is no longer distracted to such a circuit, so that the user can concentrate on telling whether the LED is or is not illuminated. Preferably, the coloring of the housing is such that the housing is completely non-transparent and only the specific wavelength of the LED, when illuminated, can be seen from outside the housing.

In principle, the color of the housing of the electrical plug connector is independent on what configuration the electrical plug connector would otherwise have. For example, the electrical plug connector may already be ready-wired and connected to an electrical cable, in which case one end of the cable is then sealed on the side of the housing facing away from the contact mount. Since the housing is generally produced using an injection-moulding process, the end of the cable, which is electrically connected to the electronics circuit, is thus also directly extrusion-coated during the production of the electrical plug connector.

Alternatively, however, the electrical plug connector can also be designed such that it can be wired up as required, so that the electrical plug connector has appropriate connecting elements for connection of the individual conductors of a separate electrical cable. Finally, the electrical plug connector may also have two contact mounts, wherein the contacts of the second contact mount are likewise electrically connected to the electronics circuit, so that a cable, which is connected to a corresponding mating contact mount, can then be connected to the second contact mount.

According to another particular embodiment of the invention, the electrical plug connector has at least two LEDs that are arranged under a transparent cover within the housing, and with two symbols, which are associated with the two LEDs, formed in the housing above the cover. The two symbols have preferably the shape of two arrows that point in opposite directions and through which the light from the respective LEDs can pass.

An embodiment of the electrical plug connector such as this is particularly advantageous when the electrical plug connector is intended to be connected to so-called "intelligent" sensors, which have an integrated microcontroller. In an electrical plug connector such as this, the electronics circuit of the plug connector likewise has a microcontroller, so that the sensor is not only supplied with electrical power via the plug connector, but data also can be transmitted to and from the sensor via the electrical plug connector. The symbols which are formed in the housing, in particular by being embossed, can then indicate the direction of the actual data transfer, by the illumination of the LED associated with the corresponding symbol. Reference should be made to the subsequently published German Patent Application No. DE 10 2005 049 483 A1, which corresponds to U.S. Patent Application Publication No. 2007/0126570 A1, for the specific configuration of an "intelligent" electrical plug connector such as this, and incorporated by reference herein.

The transparent cover, which is arranged above the LEDs, may in this case be used in particular for focusing and guidance of the light emitted from the LEDs to the symbols formed in the housing. The cover is in this case is preferably configured in the form of a shutter or aperture, such that only the light coming from the associated LED in each case passes through the two symbols. This ensures that, despite the physical proximity of the two LEDs within the housing, light passes only through the symbol associated with the respective LED when that LED is illuminated.

The LEDs are preferably mounted using surface mount device (SMD) technology on a printed circuit board associated with the electronics circuit or on a flexible conductor film, so that a plurality of LEDs can be used even in a relatively small housing, as is the case with M8 plugs.

There are a large number of possible ways to refine and develop the electrical plug connector according to the invention. For this purpose, reference is made on the one hand to the appended claims, and on the other hand to the following description of the preferred exemplary embodiments of the invention described with reference to the attached drawings.

DETAILED DESCRIPTION OF THE INVENTION

Figure 1:
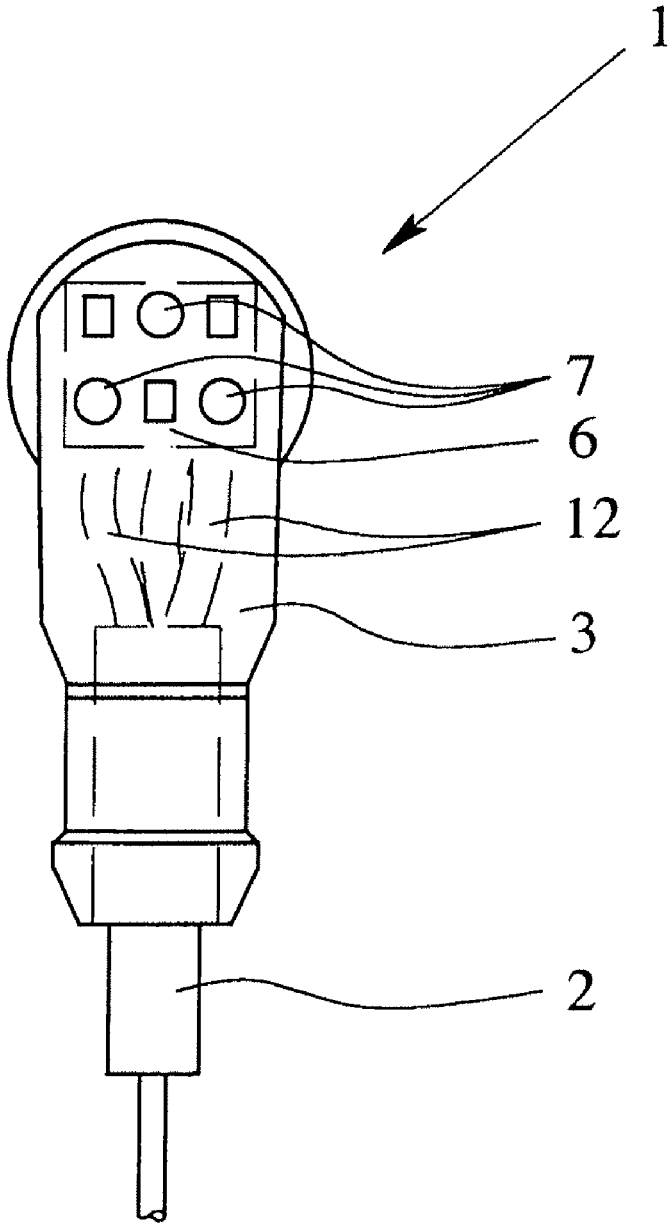
FIG. 1 shows an electrical plug connector according to the prior art.
Figure 2A:
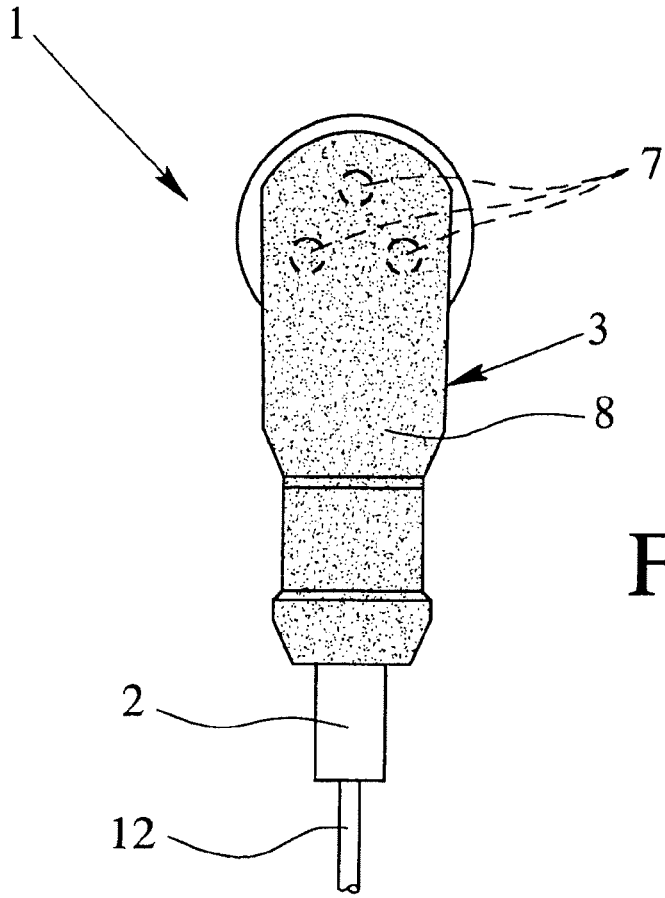
FIGS. 2*a*-2*b* show a rear view of an exemplary electrical plug connector with illuminated and non-illuminated LEDs, according to the invention.
Figure 2B:
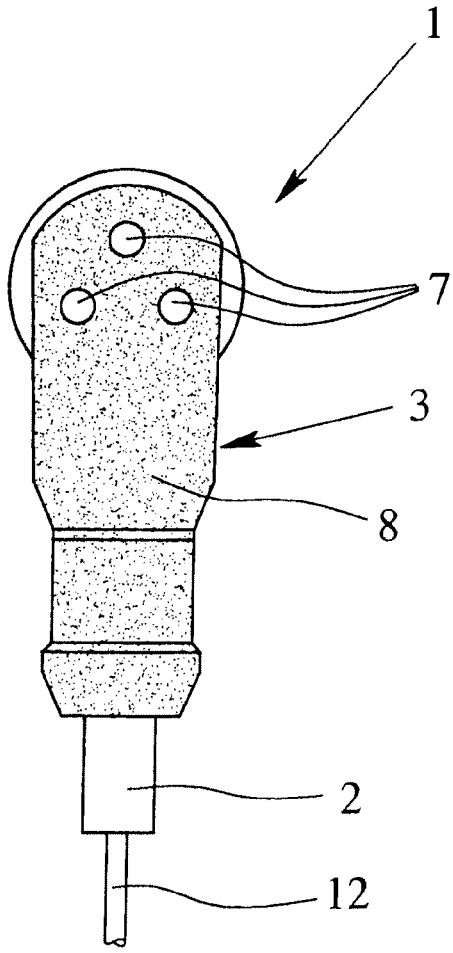
Figure 3A:
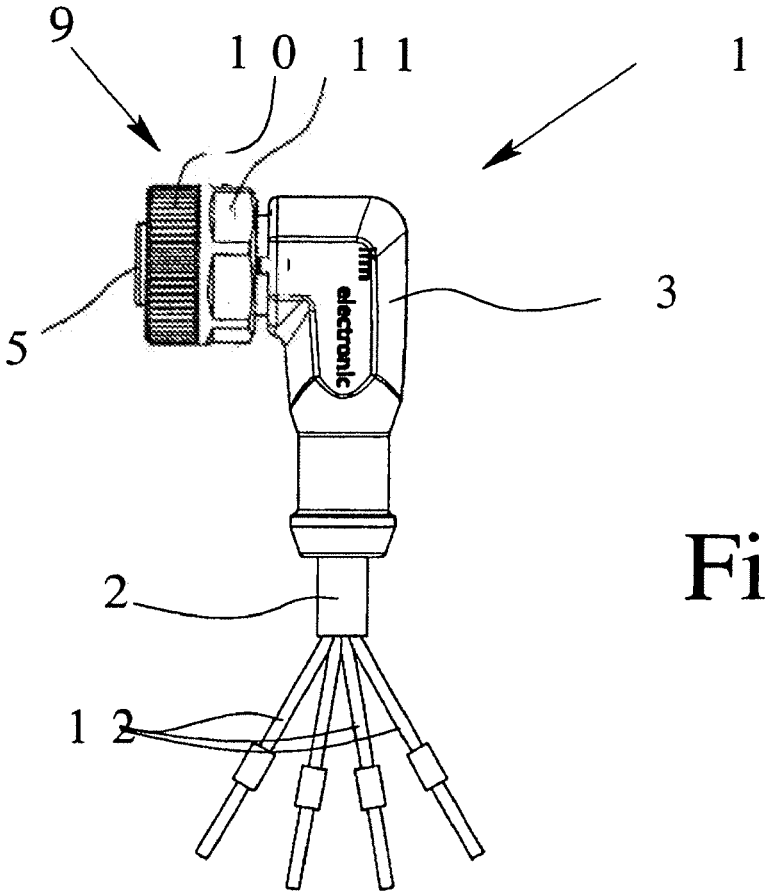
FIGS. 3*a*-3*b* show side and front views of the electrical plug connector of FIG. 2.
Figure 3B:
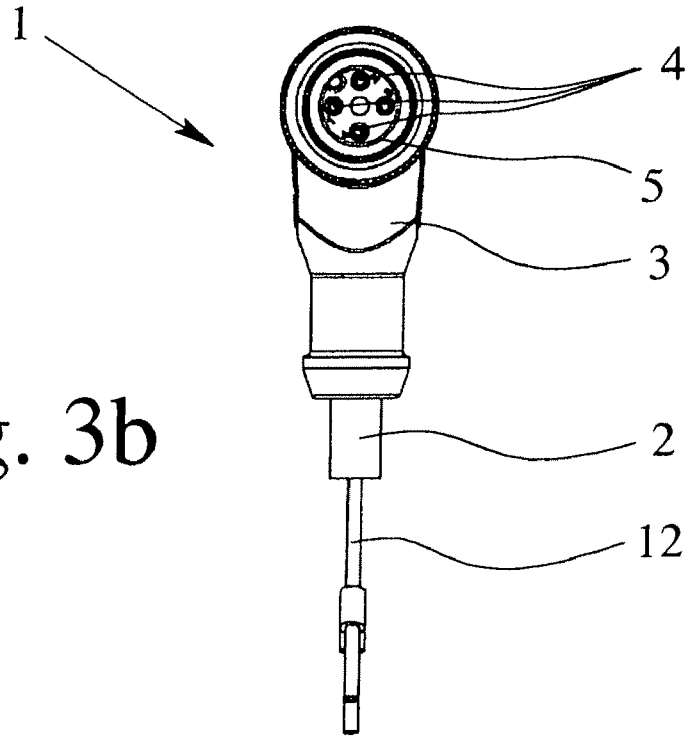
Figure 4A:
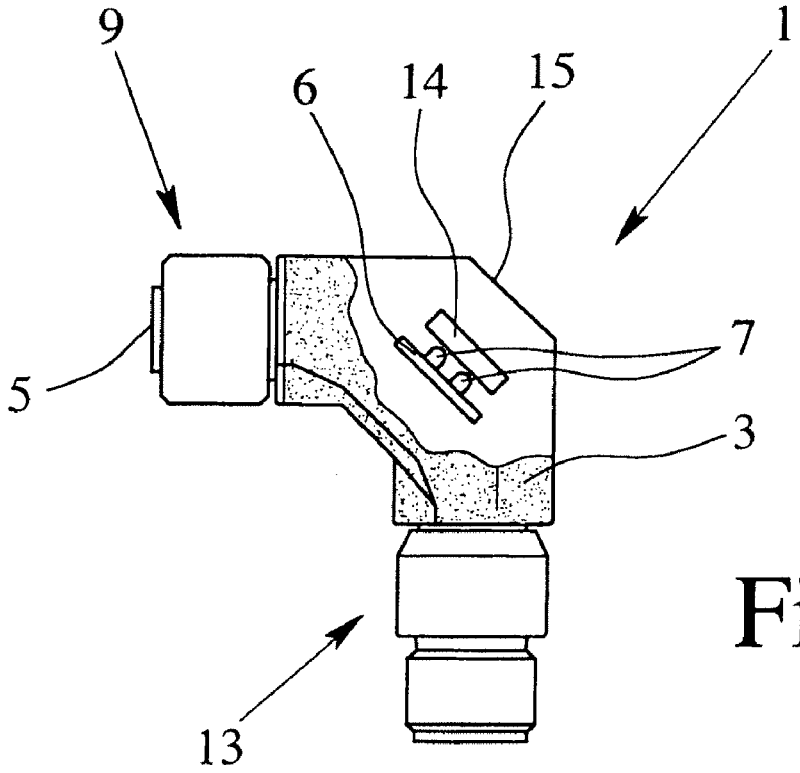
FIGS. 4*a*-4*b* show side and rear views of another exemplary embodiment of an electrical plug connector according to the invention.
Figure 4B:
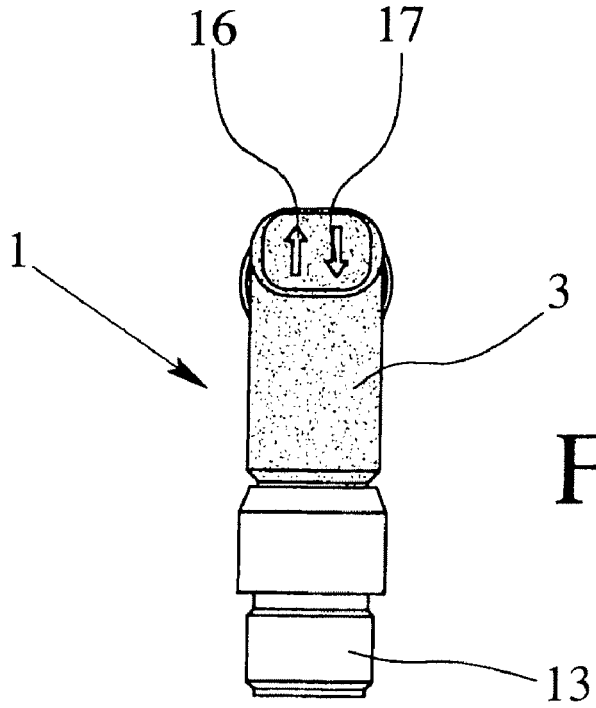

The figures show various exemplary embodiments of an electrical plug connector 1, with FIG. 1 showing an electrical plug connector 1 according to the prior art and FIGS. 2 to 4 showing two variants of an electrical plug connector 1 according to the invention. The electrical plug connectors 1 illustrated in FIGS. 1 to 3 are used for connection of an electrical cable 2 to an electronic apparatus, in particular a sensor, for example a proximity switch, a temperature sensor, a flow sensor, and the like.

The electrical plug connector 1 has a housing 3, a contact mount 5, which holds a plurality of contacts 4 and an electronics circuit 6 arranged in the housing 3. In this case, the electronics circuit 6 generally includes a printed circuit board on which, in addition to a number of electrical and electronic components, a plurality of LEDs 7, generally up to three LEDs 7, are arranged. The LEDs 7 are in this case used for status indication for the connected sensor. The electrical plug connector 1 is also referred to as a cable plug or a cable socket, dependent on whether the respective contacts arranged in the contact mount 5 are plugs or sockets.

In order to be able to tell from outside the housing 3 in the electrical plug connector 1 illustrated in FIG. 1 whether the LEDs 7 arranged in the housing 3 are or are not illuminated, the housing 3 is composed of a completely transparent plastic.

As indicated in FIG. 1, the electronics circuit 6 with the electrical and electronic components arranged on it, in particular the LEDs 7, can thus be seen through the housing 3, as well. If the electrical plug connector 1 is now subjected to strong external incident light, then it is very often no longer possible to reliably tell, especially when observed quickly, whether one or more of the LEDs 7 is or is not illuminated.

In contrast, in the case of the electrical plug connector 1 according to the invention and illustrated in FIGS. 2 to 4, the housing 3 is no longer composed of "completely" transparent material, but of a thermoplastic material to which an additive 8, which influences the transparency and color has been added. Thus, overall, the housing 3 has a grey or black color depending on the proportion by weight of the additive 8. An illuminated LED 7 can thus, as before, be seen from outside the housing 3, while an LED 7 which is not illuminated along with the electronics circuit 6 cannot be seen, or can be seen only poorly. This is illustrated in FIG. 2, wherein with the LEDs off, the LEDs 7, which are arranged in the interior of the housing 3, are illustrated by dashed lines to represent the off view, while in FIG. 2*b* with the LEDs on, the LEDs 7 are illustrated by solid lines to represent the on view.

Polyurethane (PUR) or polyether polyurethane is preferably used as the thermoplastic material for the housing 3, since these plastics have a very good resistance to oils, and are considerably better than thermoplastic elastomer (TPE). In this case, the proportion by weight of the additive 8 is chosen, preferably in the range from 1% to 3%, such that the transparency of the thermoplastic material of the housing 3 is decreased by 20 to 40%, preferably by about 30%. Advantageously, the resultant increase in contrast considerably improves the capability to see an illuminated LED 7, particularly in the presence of incident light.

The electrical plug connectors 1 according to the invention and illustrated in FIGS. 2 to 4 have a union nut 9 for mechanical connection to a corresponding mating plug connector, which is arranged such that it can rotate and can be moved axially to a limited extent on the contact mount 5. The union nut 9, which has an internal thread, and can thus be screwed onto a sleeve, which has a corresponding external thread, on a mating plug connector. In order to make is easier to screw the union nut 9 on, it has a knurl 10 on its outer circumference. The electrical plug connector 1 also has vibration protection, which prevents the union nut 9 from inadvertently becoming loose from the sleeve of the mating connector. The vibration protection is in this case provided by any suitable appropriate configuration of the contact mount 5 and of the union nut 9. In order to allow the union nut 9, which has been tightened firmly, to be released relatively easily again, the union nut 9 also has flat portions 11 for a spanner or wrench, and the like.

While, in the case of the electrical plug connector 1 illustrated in FIGS. 2 and 3, wherein the conductors 12 in the electrical cable 2 have already been firmly connected to the electronic circuit 6 and the electrical cable 2 has been surrounded by the housing 3 on the side facing away from the contact mount 5, the electrical plug connector 1 shown in FIG. 4 has a second contact mount 13, which is provided for connection of a cable 2 with a corresponding plug. An electrical plug connector 1 such as this can also be referred to as an adaptor. In addition to this difference with respect to the connection of the electrical cable 2, the electrical plug connector illustrated in FIG. 4 also has further differences from the plug connectors 1 illustrated in FIGS. 2 and 3.

Specifically, the electrical plug connector 1 illustrated in FIG. 4 is an "intelligent" plug connector 1 that is intended for connection to an "intelligent" sensor that includes a microcontroller. The sensor can then not only be supplied with electrical power via the electrical plug connector 1, which likewise has a microcontroller, but data can also be transmitted from and to the sensor. Reference is made to the subsequently published German Patent Application No. DE 10 2005 049 483 A1, which corresponds to U.S. Patent Application Publication No. 2007/0126570 A1, incorporated by reference herein, with regard to the further configuration of the "intelligent" plug connector 1 illustrated in FIG. 4, in particular with regard to the configuration and function of the microcontroller associated with the electronics circuit 6.

As can be seen from FIG. 4*a*, in the case of the electrical plug connector 1 illustrated therein, a transparent cover 14 is arranged between the electronics circuit 6, which has two LEDs 7, and the upper face of the housing 3, and through which light emitted from the LEDs 7 is passed to the upper face 15 of the housing 3. Two arrows 16, 17, which point in opposite directions are formed, in particular embossed, on the upper face 15 of the housing 3 associated with the LEDs 7, through which light from a respectively associated LED 7 can shine. In fact, the two LEDs 7 illustrated in FIG. 4*a* can be arranged one behind the other in the plane of the drawing, and not alongside one another, as illustrated. The cover 14 is in this case used not only for guidance of the light emitted from the LEDs 7 but furthermore, also as a shutter or aperture, which is designed such that the light shines only through one of the arrows 16, 17 in each case from the associated LED 7. The operator can thus tell immediately, depending on which arrow 16, 17 is or is not illuminated, the direction, for example, in which data is being transferred through the "intelligent" electrical plug connector 1.

In addition to the embodiments of the electrical plug connector 1 illustrated in the figures, which each relate to an embodiment angled through 90°, in which the longitudinal direction of a connected electrical cable 2 and the longitudinal direction of the contacts 4 of the contact mount 5 therefore form an angle of about 90°, the electrical plug connector 1 may, of course, also be in the form of a "straight" plug connector. Furthermore, the electrical plug connector 1 shown in FIG. 4 also has an inclined area in which the symbols, which are in the form of arrows 16, 17, are embossed in the housing 3 or in the upper face 15 of the housing 3.

What is claimed is:

1. An electrical plug connector for connection of an electrical cable to an apparatus, including a sensor or an actuator, or for detachable connection of two electrical cables to one another, the electrical plug comprising:

a housing, having a contact mount that holds a plurality of contacts, and including an electronics circuit arranged in the housing and with the electronics circuit having at least one light-emitting element, including an LED and being electrically connected to the contacts, wherein the housing is composed of a thermoplastic material, at least in an area of the light-emitting element, the thermoplastic material having an additive that influences transparency and color, and that reduces the transparency of the thermoplastic material, and wherein the additive is a color concentrate with at least one of an organic and an inorganic colorant, and having a dark color, so that when the LED is illuminated, the LED is seen from outside the housing, and when the LED is not illuminated, the LED and the electronics circuit are not seen or are seen only poorly, and a clear increase in contrast is achieved, and so that a status of the LED is easily seen when the plug connector is subject to strong external incident light.

2. The electrical plug connector of claim 1, wherein the proportion by weight of the additive is less than 5%.

3. The electrical plug connector of claim 1, wherein the proportion by weight of the additive is between 1% and 3%.

4. The electrical plug connector of claim 1, wherein the thermoplastic material is selected from the group consisting of polyurethane (PUR), polyether-polyurethane, thermoplastic elastomer (TPE) or polyvinylchloride (PVC).

5. The electrical plug connector of claim 1, wherein the housing is composed entirely of the thermoplastic material which is provided with the additive.

6. The electrical plug connector of claim 1, wherein the transparency and color of the housing is such that the housing is completely non-transparent and only the specific wavelength of the light-emitting element is viewable from outside of the housing.

7. The electrical plug connector of claim 1, wherein a union nut is provided and is arranged on the contact mount such that the union nut rotates and moves axially to a limited extent, and wherein the union nut has a thread and is screwed to a sleeve that has a corresponding thread on a mating plug connector.

8. The electrical plug connector of claim 1, wherein the conductors of an electrical cable are connected to the electronics circuit and the electrical cable is surrounded by the housing on the side facing away from the contact mount.

9. The electrical plug connector of claim 1, wherein a second contact mount, which holds a plurality of contacts, is arranged on the side of the housing facing away from the first contact mount with the contacts of the second contact mount being electrically connected to the electronics circuit.

10. The electrical plug connector of claim 1, wherein a plurality of differently colored LEDs are provided, and used for status indication.

11. The electrical plug connector of claim 9, wherein the LEDs are surface mounted devices (SMDs).

12. The electrical plug connector of claim 1, comprising two LEDs, wherein the LEDs are arranged under a transparent cover which is arranged within the housing, and including two symbols that are formed in the housing above the cover and which are associated with the two LEDs, the symbols including two arrows that point in opposite directions and through which the light from the LEDs passes.

13. The electrical plug connector of claim 12, wherein the cover is in the form of an aperture such that only light coming from the associated LED respectively passes through the two symbols.

14. The electrical plug connector of claim 1, wherein the plug connector has a cross section which is angled through about 90°, such that there is an angle of about 90° between a longitudinal direction of a connected electrical cable and a longitudinal direction of the contacts.

15. The electrical plug connector of claim 5, wherein the transparency and color of the housing is such that the housing is completely non-transparent and only the specific wavelength of the light-emitting element is viewable from outside of the housing.

* * * * *